US009182102B2

(12) United States Patent
Hyun et al.

(10) Patent No.: US 9,182,102 B2
(45) Date of Patent: Nov. 10, 2015

(54) REFLECTOR HAVING REFLECTION PATTERN FOR COMPENSATING FOR LIGHTING CHARACTERISTIC OF LED PACKAGE AND LED LAMP INCLUDING THE SAME

(71) Applicants: Dong Hoon Hyun, Siheung-si (KR); Myeung Jae Noh, Uiwang-si (KR)

(72) Inventors: Dong Hoon Hyun, Siheung-si (KR); Myeung Jae Noh, Uiwang-si (KR)

( * ) Notice: Subject to any disclaimer, the term of this patent is extended or adjusted under 35 U.S.C. 154(b) by 0 days.

(21) Appl. No.: 14/364,424

(22) PCT Filed: Nov. 15, 2012

(86) PCT No.: PCT/KR2012/009628
§ 371 (c)(1),
(2) Date: Jun. 11, 2014

(87) PCT Pub. No.: WO2013/089354
PCT Pub. Date: Jun. 20, 2013

(65) Prior Publication Data

US 2014/0340908 A1 Nov. 20, 2014

(30) Foreign Application Priority Data

Dec. 14, 2011 (KR) ..... 10-2011-0134430

(51) Int. Cl.

| | |
|---|---|
| ***F21V 7/04*** | (2006.01) |
| ***F21K 99/00*** | (2010.01) |
| ***F21V 13/04*** | (2006.01) |
| *F21Y 101/02* | (2006.01) |

(52) U.S. Cl.
CPC ... *F21V 7/04* (2013.01); *F21K 9/50* (2013.01); *F21V 7/048* (2013.01); *F21V 13/04* (2013.01); *F21Y 2101/02* (2013.01)

(58) Field of Classification Search
CPC ..... B60Q 7/00; F21K 99/00; F21K 9/50; F21S 4/003; F21V 7/0083; F21V 7/04; F21V 7/048; F21V 13/04; G02B 6/0038; G02F 2201/34; Y10S 362/80
USPC ..... 313/269
See application file for complete search history.

(56) References Cited

U.S. PATENT DOCUMENTS

| | | | |
|---|---|---|---|
| 7,455,443 | B2 | 11/2008 | Sakurai et al. |
| 2002/0093820 | A1 | 7/2002 | Pederson |

FOREIGN PATENT DOCUMENTS

| | | |
|---|---|---|
| JP | 10112209 | 4/1998 |
| JP | 2011090854 | 5/2011 |
| KR | 1020070012198 | 1/2007 |
| KR | 200447539 | 1/2010 |

OTHER PUBLICATIONS

Akashi, Japanese Patent publication 10-112209,Apr. 1996, machine translation.*
ishioka, (Japanese Patent Application 2011-090854, Jun. 2011, machine translation).*
International Search Report—PCT/KR2012/009628 dated Feb. 28, 2013.

* cited by examiner

*Primary Examiner* — Tracie Y Green
(74) *Attorney, Agent, or Firm* — Cantor Colburn LLP

(57) ABSTRACT

A reflector having a reflection pattern for compensating for a lighting characteristic of an LED package includes a body configured to be matched and coupled with the LED package having a discontinuous chip arrangement structure to improve the lighting characteristic of the LED package for divergent light. The body includes an inner wall having a diameter which is increased upwardly to form a narrow bottom and a wide top and including an opening formed at a lower end thereof so as to arrange the LED package therein. The inner wall of the body is formed with a trigonometric cross-wave pattern part which is patterned such that sine wave-type waves curved to form peaks and valleys are arranged to cross in a horizontal direction and a vertical direction at predetermined intervals over the whole area. The reflection pattern can compensates for an incomplete lighting characteristic of an LED package itself.

6 Claims, 17 Drawing Sheets

(a) (b)

(a) (b)

(a) (b)

(a) (b)

(a)

(b)

REFLECTOR HAVING REFLECTION PATTERN FOR COMPENSATING FOR LIGHTING CHARACTERISTIC OF LED PACKAGE AND LED LAMP INCLUDING THE SAME

TECHNICAL FIELD

The present disclosure relates to a reflector to be used in combination with an LED package and an LED lamp including the same. More particularly, the present disclosure relates to a reflector having a reflection pattern for compensating for lighting characteristics of an LED package in which the reflection pattern is capable of compensating for an unstable chip configuration of an LED package itself due to discontinuous chip mounting and an incomplete lighting characteristic caused by the unstable chip configuration, improving LED lamp efficiency while using an existing LED package as a light source as it is, and enabling implementation of a product at a low cost, and an LED lamp including the reflector.

BACKGROUND

Recently, LEDs have been more widely used as light sources throughout the industry including lighting devices. Thus, researches are actively carried out in each industrial field so as to use LEDs effectively and efficiently.

In particular, researches for LED lamps as new lamps in a concept of replacing traditional lamps have come to greatest prominence.

However, LED-related companies and markets lack basic knowledge of traditional lamps and actual approaches thereof do not fulfill the expectations. In particular, in the price range which is put first in the market, the price of LED lamps is very high to the extent that LED lamps cost five times to twenty times as much as traditional lamps. Thus, in practice, the LED lamps are very inadequate as a replacement for the traditional lighting sources.

For example, a Multifaceted Reflector (MR) lamp of a halogen lamp, which is a kind of traditional lamp, has a form and configuration in which a reflective material is uniformly coated on respective facets on a reflecting plate surface of a pressed glass having a polyhedron structure and the respective facets exhibit a characteristic of optically collecting or concentrating light emitted from a filament. Some MR lamps have a smooth structure rather than a polyhedron structure but yet, are collectively called "MR lamp" or "MR 16" (here, the number 16 indicates the largest diameter size of the MR lamp).

Such MR lamps were originally developed for use as a light source of a slide projector. At present, the MR lamps are widely used for direct lighting, such as indoor lighting of department stores, hotels, restaurants, or the like, or for display lighting.

However, there is an inconvenience in that attention should be paid always when using such an MR lamp which is a kind of traditional lamp since a dangerous situation may occur when the MR lamp is not normally used.

Specifically, the temperature of the filament increases to at least 260° C. and a halogen regeneration cycle is executed during lighting-up. Thus, there is danger of burns due to the high temperature and attention should be paid when handling an object which may be damaged by heat. When the heated filament lamp surface is touched by hand, the lamp may be destroyed. Further, since the MR lamp is not a light source with high efficiency like a fluorescent light, there is a limit in that the MR lamp is not suitable for an application for entire lighting but only for localized lighting.

In order to overcome the above-mentioned disadvantages of the existing MR lamps and enhance efficiency, the LED lamps for use in MR lamp replacement, which include a chip type LED module (LED package), are proposed in the forms as illustrated FIGS. 1*a* and 1*b*. Most of the LED lamps include a chip type LED package, a heat sink, and a socket.

Here, as illustrated in FIG. 1*a*, a lens unit having a plurality of lenses, of which the number corresponds to the number of LED chips of the LED module in a one-to-one relationship, may be provided, or in some cases, a transparent or translucent cover may be provided instead of the lens unit.

In addition, in order to improve efficiency, the LED lamps may further include a reflector configured to control divergent light of the LED chips.

Here, in order to replace an existing 50 W MR lamp, a chip type LED package with 8 W to 10 W power is used, and in order to replace an existing 20 W MR lamp, a chip type LED package with a 4 W to 5 W power is used.

However, the LED lamps conventionally proposed for use in MR lamp replacement have a problem in that the energy efficiency and lighting efficiency are not so high compared to the existing MR lamps. When the power of the LED packages is increased in order to solve this problem, the efficiency of the LED packages may be improved. However, this newly causes problems of increasing the price. In addition, there is also a problem in that the sizes of the LED lamps as well as the sizes of the LED packages are increased. Further, there is an inconvenience in that a problem of heat dissipation caused by the size increase should be solved.

In addition, an LED package in which a plurality of chips is arranged at an interval basically has an unstable chip arrangement due to discontinuous chip mounting. Due to this, the LED package unavoidably has an incomplete lighting characteristic. This will cause a problem of locally deforming color coordinates, generating a color separation phenomenon. In particular, there is a problem in that, as illustrated in FIG. 9*b*, a yellow pattern such as a yellow stripe and a black portion are formed on a light radiation surface.

Furthermore, in the LED lamps conventionally proposed for use in MR lamp replacement, the yellow pattern is not removed even though a reflector and/or a cover are provided. Thus, an improvement in terms of efficiency is requested and a product which may be implemented at a low cost is demanded.

DISCLOSURE OF THE INVENTION

Technical Problems to be Solved

The present disclosure has been made in an effort to solve the above-mentioned problems, and an object of the present disclosure is to provide a reflector having a reflection pattern for compensating for lighting characteristics of an LED package in which the reflection pattern is capable of compensating for an unstable chip configuration of an LED package itself due to discontinuous chip mounting and an incomplete lighting characteristic caused by the unstable chip configuration, improving lighting efficiency of an LED lamp while using an existing LED package as a light source as it is, and enabling implementation of a product at a low cost, and an LED lamp including the reflector.

Another object of the present disclosure is to provide an LED lamp which may replace a halogen lamp (MR lamp) which is in common use as an existing MR 16 while improving lighting efficiency, and may remove a color separation phenomenon and a yellow pattern such as a yellow stripe which are generated in a conventionally proposed LED lamp for use in MR lamp replacement.

Still another object of the present disclosure is to provide an LED lamp in which a reflector having a reflection pattern for compensating for lighting characteristics of an LED package and an aspheric lens are coupled with each other via a cover such that a final radiation angle of a light source can be further narrowed, which allows the LED lamp to be used as a head lamp of a vehicle or a motorcycle, a spotlight in a stadium, a light in a harbor, or the like.

Means to Solve the Problems

In order to achieve the above-mentioned objects, there is provided a reflector having a reflection pattern for compensating for a lighting characteristic of an LED package. The reflector includes a body configured to be matched and coupled with the LED package having a discontinuous chip arrangement structure to improve the lighting characteristic of the LED package for divergent light. The body includes an inner wall having a diameter which is increased upwardly to form a narrow bottom and a wide top and including an opening formed at a lower end thereof so as to arrange the LED package therein. In addition, the inner wall of the body is formed with a trigonometric cross-wave pattern part which is patterned such that sine wave-type waves curved to form peaks and valleys are arranged to cross in a horizontal direction and a vertical direction at predetermined intervals over the whole area.

Assuming that a pattern cycle of the trigonometric cross-wave pattern part is "H1" and a chip mounting cycle of the LED package is "L1", the trigonometric cross-wave pattern part may be formed to satisfy Condition Equation 1 and Condition Equation 2 as follows:

$$mH_1=nL_1 (m \text{ and } n \text{ are integers}) \quad \text{Condition Equation 1}$$

$$H_1=H_i(i=2,3,4,\ldots),L_1=L_j(j=2,3,4,\ldots) \quad \text{Condition Equation 2}$$

The body having the trigonometric cross-wave pattern part on the inner wall thereof may include a base layer formed of a polymer synthetic resin material having a polarity, an aluminum layer coated on the base layer, and a dielectric layer coated on the aluminum layer.

The dielectric layer may be formed of a dielectric material having a low refractive index in a range of 1.4 to 1.5.

In addition, there is also provided an LED lamp including a reflector having a trigonometric cross-wave pattern part on an inner wall.

The LED lamp may further include a transparent cover disposed above the reflector to provide a protection cover function and a waterproof function. The transparent cover is formed as an aspheric lens to narrow a radiation angle of light passing through the reflector.

Advantageous Effect

According to the present disclosure, it is possible to compensate an unstable chip configuration of an LED package itself due to discontinuous chip mounting and an incomplete lighting characteristic caused by the unstable chip configuration to improve lighting efficiency of an LED lamp, to implement a product at a low cost, to replace an existing MR lamp with an LED lamp while improving the lighting efficiency. In addition, it is possible to remove a color separation phenomenon, a yellow pattern such as a yellow stripe, a hot spot, and a dark part which are generated in the conventional LED lamp for use in MR lamp replacement due to the incomplete light characteristic of the LED package itself.

According to the present invention, the LED lamp is configured by coupling a reflector having a reflection pattern for compensating for lighting characteristics of an LED package and an aspheric lens to be matched such that the LED lamp can be used as a head lamp of a vehicle or a motorcycle, a spotlight in a stadium, a light in a harbor, or the like. Thus, the LED lamp can be properly modified to be suitable for use purpose and the application ranges of the reflector having the reflection pattern and the LED can be extended.

DESCRIPTION OF SYMBOL

Figure 1A:
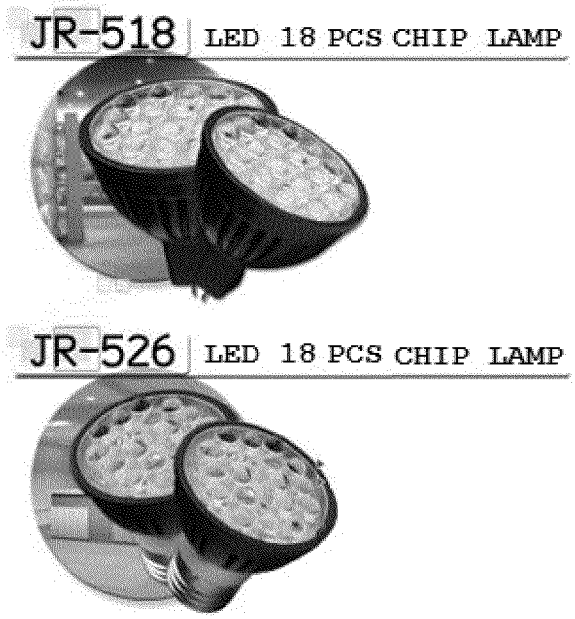
Fig. 1a Prior Art
FIGS. 1*a* and 1*b* are photographs illustrating conventional LED lamps for use in MR lamp replacement.
Figure 1B:
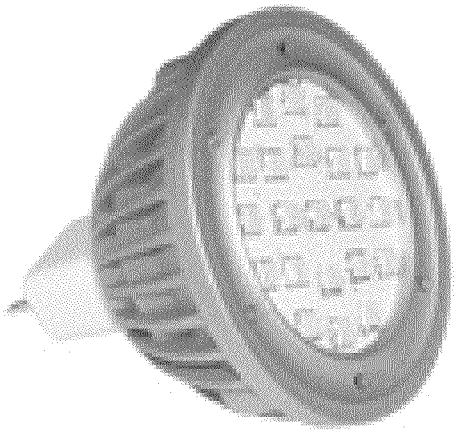
Fig. 1b Prior Art

100: reflector
110: body
110*a*: base layer
110*b*: aluminum layer
110*c*: dielectric layer
120: trigonometric cross-wave pattern part
200, 300, 400: LED lamp
210, 310, 410: LED package
430: transparent cover (aspheric lens)

Best Mode to Execute the Invention

Hereinafter, embodiments of the present disclosure will be described with reference to the accompanying drawings. The objects and configurations of the present disclosure and features related thereto will be more easily understood through the detailed description.

Figure 2:
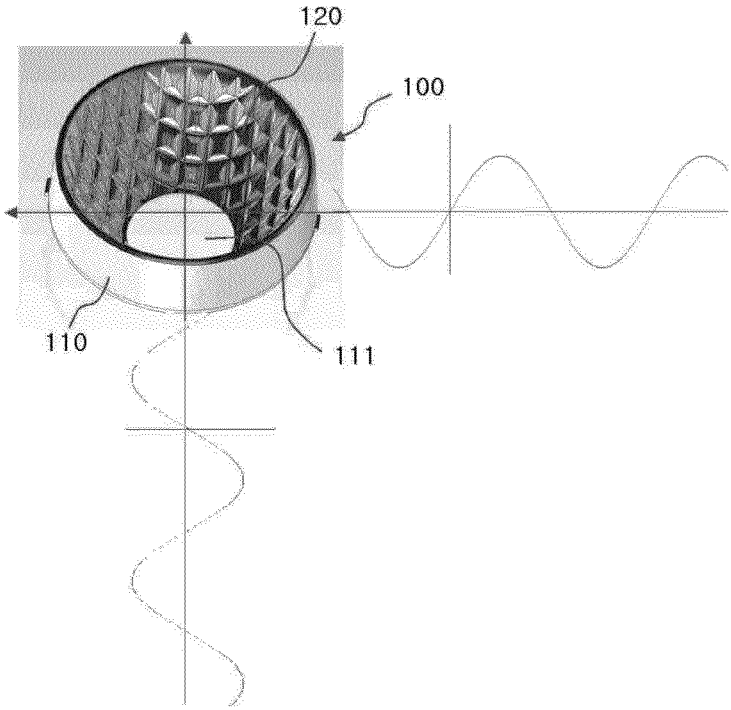
FIGS. 2 and 3 are views for describing a reflector having a reflection pattern for compensating for a lighting characteristic of an LED package according to an embodiment of the present disclosure.
Figure 3:
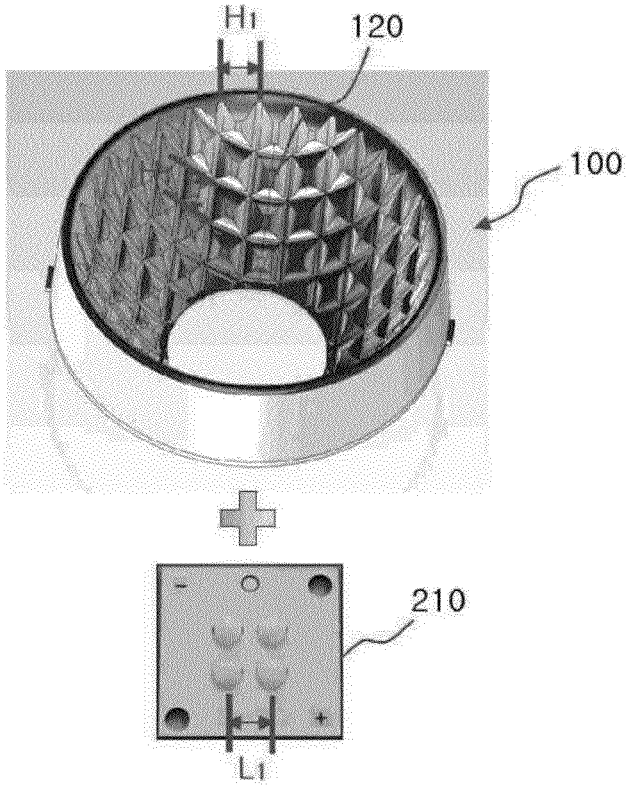
Figure 4:
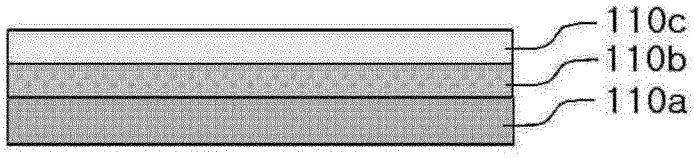
FIG. 4 is a view illustrating a cross-sectional layer structure of a reflector according to the present disclosure.

According to an embodiment of present disclosure, a reflector 100 having a reflection pattern for compensating for a lighting characteristic of an LED package has a basic characteristic which is capable of compensating for a performance of an LED package having an unstable chip structure due to discontinuous chip mounting. As illustrated in FIGS. 2 to 4, the reflector 100 includes a body 110 with an inner wall having a diameter which is increased upwardly to form a narrow bottom and a wide top and an opening 111 is formed at the lower end of the body 110 so as to arrange a chip type LED package 210 therein.

The inner wall of the body 110 is formed with a trigonometric cross-wave pattern part 120 which is patterned such that sine wave-type waves curved to form peaks and valleys are arranged to cross in a horizontal direction and a vertical direction at predetermined intervals over the whole area.

The trigonometric cross-wave pattern part 120 is provided so as to improve lighting efficiency influenced by a light irradiation surface by controlling light to compensate an incomplete lighting characteristic of an LED package 210 itself due to a discontinuous chip arrangement structure which is basically provided in the LED package 210 used by being coupled as a light emitting body for lighting, and in particular, so as to completely remove a yellow pattern such as a yellow stripe generated on the light irradiation surface due to the incomplete characteristic of the LED package in a conventionally used LED lamp for use in MR 16 lamp replacement.

At this time, assuming that the pattern cycle of the trigonometric cross-wave pattern part 120 is "H1" and the chip mounting cycle of the LED package 210 is "L1" as illustrated in FIG. 3, the trigonometric cross-wave pattern part 120 is preferably formed to satisfy Condition Equation 1 and Condition Equation 2 as follows.

$$mH_1=nL_1 (m \text{ and } n \text{ are integers}) \quad \text{Condition Equation 1}$$

$$H_1=H_i(i=2,3,4,\ldots),L_1=L_j(j=2,3,4,\ldots) \quad \text{Condition Equation 2}$$

In addition, the body 110 having the trigonometric cross-wave pattern part 120 on the inner wall thereof may be preferably configured to improve lighting efficiency and to enable implementation of the LED lamp as well as the reflector 100 at a low cost. As illustrated in FIG. 4, the body 110 includes a base layer 110*a* formed of a polymer synthetic resin material having a polarity, an aluminum layer 110*b* coated on the base layer 110*a*, and a dielectric layer coated on the aluminum layer 110*b*.

When a synthetic resin is used for the base layer 110*a*, the shape of the reflector 100 may be easily formed and the pattern of the trigonometric cross-wave pattern part 120 may be easily formed. When a polymer material having a polarity such as ABS resin, PE or PMMA is used, affinity with the aluminum layer 110*b* which is a metallic material may be enhanced and coating efficiency may be enhanced.

The aluminum layer 110*b* is to provide a heat dissipation function capable of radiating heat while enhancing reflection efficiency of divergent light of the LED package 210 and may be most efficiently coated through a plasma process.

The dielectric layer 110*c* serves to protect the aluminum layer 110*b* configured to enhance the reflection efficiency as well as to prevent the oxidation of the aluminum layer 110*b*. That is, the dielectric layer 110*c* is provided so as to prevent degradation of reflectivity.

The dielectric layer 110*c* is preferably formed of a dielectric material having a low refractive index in a range of 1.4 to 1.5, for example, $TiO_2$, $MgF_2$, or $SiO_2$.

Figure 5:
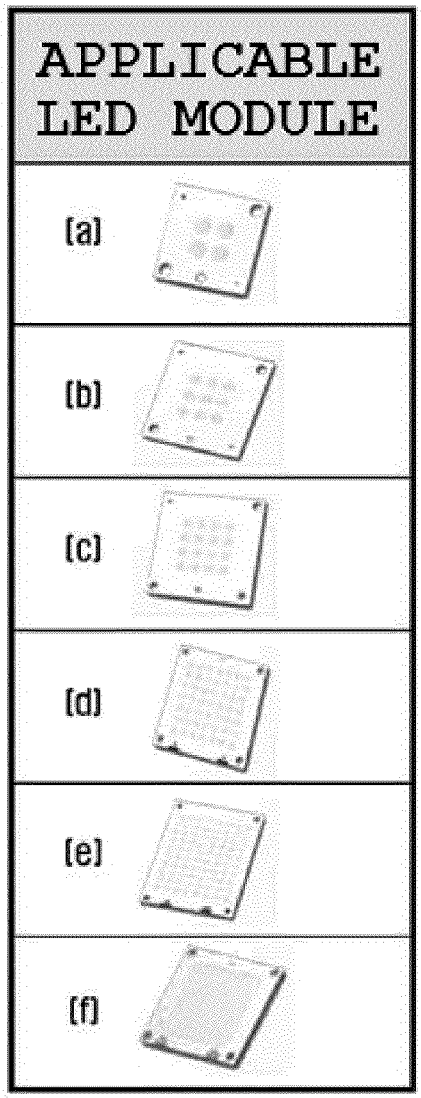
FIG. 5 is a view illustrating an LED package type having a discontinuous chip arrangement structure which is matched and coupled with a reflector having a trigonometric cross-wave pattern part.

At this time, as the LED package 210 used to be matched and coupled with the reflector 100 according to the present disclosure, LED package products having a discontinuous chip arrangement structure manufactured by Light Ocean Corp. may be applied as a base. As illustrated in FIGS. 3 and 5, any LED package products having a plurality of chips which are discontinuously arranged on one single substrate in a form of 2×2, 3×3, . . . , or n×n may be applied.

The reflector 100 of the present disclosure configured as described above improves the lighting characteristic which is incomplete for divergent light by the LED package 210 itself, in which the refraction action exhibited in all directions through the trigonometric cross-wave pattern part 120 formed on the inner wall thereof and the uniform control may maximize the reflection efficiency and prevent a localized color coordinate deformation to suppress the color separation phenomenon. As a result, the yellow pattern such as a yellow stripe which has been frequently produced on a light irradiation surface where light arrives may be removed by an action that induces a change of a radiation pattern of the LED package which has an incomplete lighting characteristic by itself.

Figure 6:
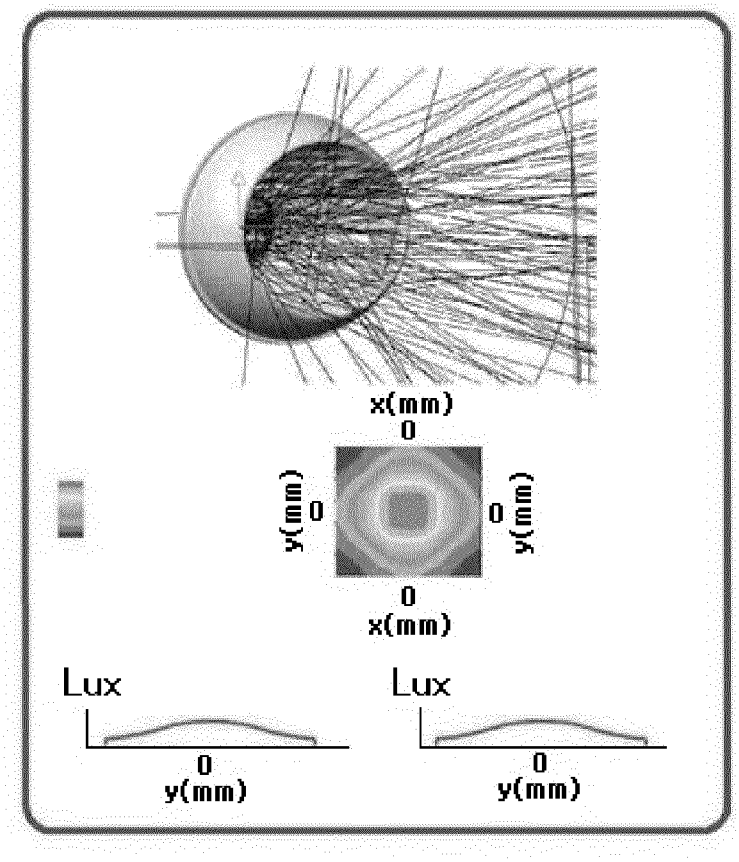
FIG. 6 is a simulation view illustrating a light distribution density of the LED lamp which includes the reflector having the trigonometric cross-wave pattern part according to the present disclosure.

Meanwhile, FIG. 6 is a simulation view illustrating light distribution densities of an LED lamp in which a reflector 100 having the trigonometric cross-wave pattern part 120 according to the present disclosure formed on the inner wall thereof and an LED package 210 having the chip arrangement model illustrated in FIG. 3 are matched and coupled with each other. FIG. 6 shows that the light distribution density on each of the X-axis and the Y-axis mainly induces a form of straight advancing light.

Figure 7:
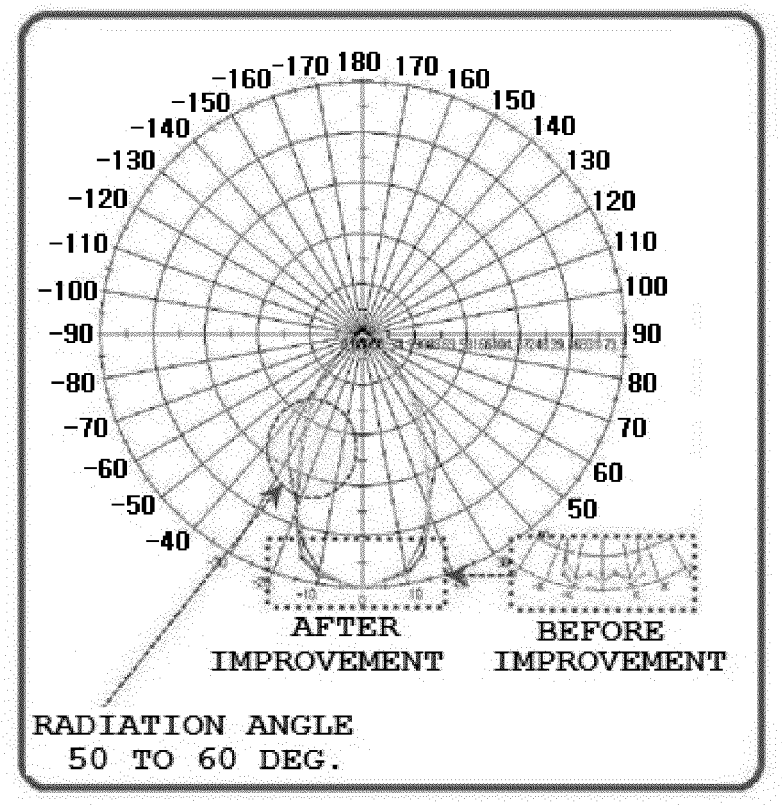
FIG. 7 is a simulation view illustrating a radiation pattern of the LED lamp which includes the reflector having the trigonometric cross-wave pattern part according to the present disclosure.

FIG. 7 is a simulation view illustrating a radiation pattern of the LED lamp in which a reflector 100 having the trigonometric cross-wave pattern part 120 according to the present disclosure formed on the inner wall thereof and an LED package 210 having the chip arrangement model illustrated in FIG. 3. FIG. 7 shows that an adjustment is made such that a radiation angle is within a range of 55 to 60 degrees for the divergent light of the LED package 210. It can be seen that a change of the radiation pattern is induced as compared to the radiation pattern prior to the improvement.

Figure 8:
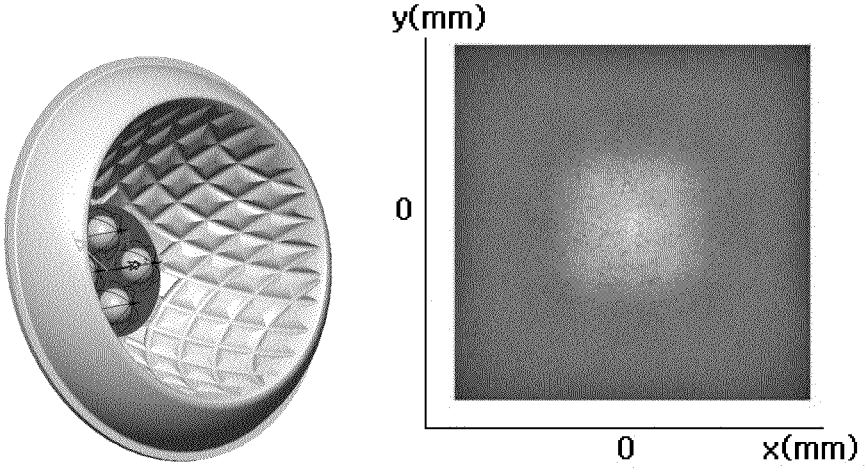
FIG. 8 is a simulation view illustrating an RGB chart of the LED lamp which includes the reflector having the trigonometric cross-wave pattern part according to the present disclosure.
Figure 9:
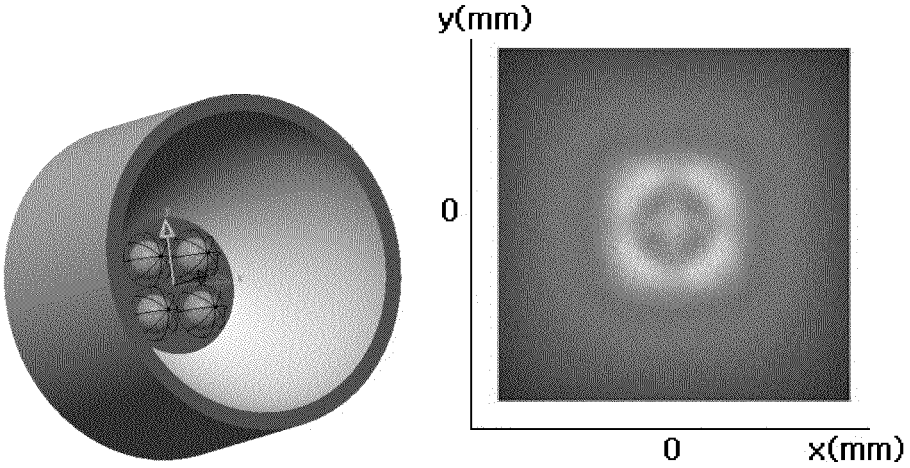
FIG. 9 is an RGB chart in a case where a reflector without a pattern is applied for comparison with the RGB chart according to the present disclosure as illustrated in FIG. 8.

FIG. 8 is a simulation view illustrating an RGB chart (a 2D raster chart of illumination indicated on a receiver) of the LED lamp which includes a reflector 100 having the trigonometric cross-wave pattern part 120 according to the present disclosure formed on the inner wall thereof and an LED package 210 having the chip arrangement model illustrated in FIG. 3. Upon comparing the RGB chart with an RGB chart in a case where a reflector without a pattern is applied as illustrated in FIG. 9, it can be seen that while the LED lamp of FIG. 9 generates a problem of generating a yellow stripe at the center of the light irradiation surface, the LED lamp which includes the reflector 100 according to the present disclosure as illustrated in FIG. 8 does not generate a yellow stripe pattern at all.

Figure 10:
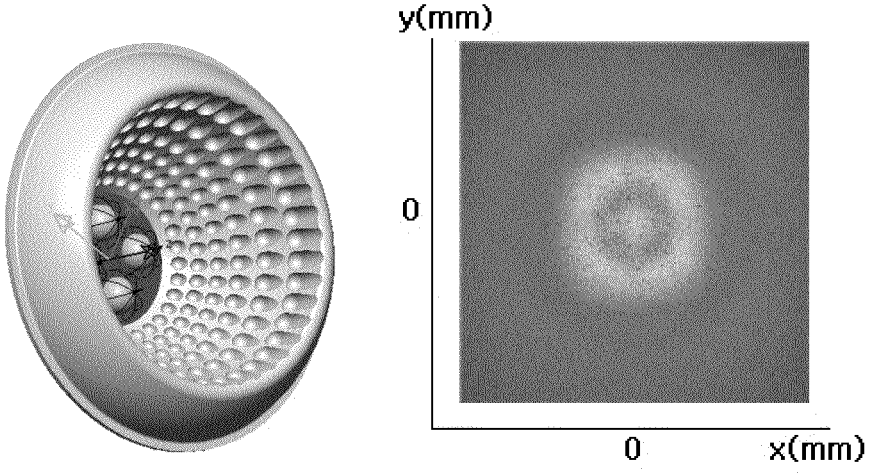
FIGS. 10 and 11 are RGB charts in a case where reflectors having patterns different from that of the present disclosure are applied for comparison with the RGB chart according to the present disclosure as illustrated in FIG. 8.
Figure 11:
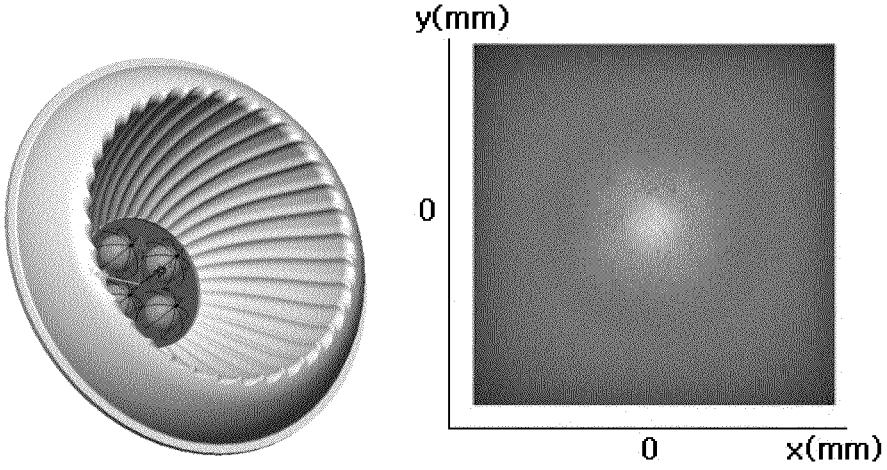

In addition, FIGS. 10 and 11 are RGB charts in a case where reflectors having patterns different from that of the present disclosure are applied for comparison with the RGB chart according to the present disclosure as illustrated in FIG. 8. The LED lamp which is provided with a pattern of embossing protrusions as illustrated in FIG. 10 does cause a change in pattern and thus, still shows the problem of generating a yellow stripe exhibited as the LED lamp illustrated in FIG. 9. The LED lamp including the reflector having a pattern as illustrated in FIG. 11 may cause a change in pattern as compared to the LED lamp of FIG. 9 but still shows the problem of generating a hot spot at the center.

Accordingly, when the reflector 100 having the trigonometric cross-wave pattern part 120 according to the present disclosure on the inner wall thereof is matched and coupled with the LED package 210 having a discontinuous chip arrangement model so as to configure an LED lamp, the unstable chip structure which is basically provided in an LED package due to the discontinuous chip mounting and the yellow pattern generated due to the incomplete lighting characteristic of the LED package itself caused by the unstable chip structure can be removed very easily by adjusting the radiation pattern.

Meanwhile, the LED lamp 200 including the reflector 100 having the reflection pattern according to the present disclosure configured as described above for compensating for the lighting characteristic of the LED package is formed in a configuration in which the reflector 100 having a technical configuration as described above and the LED package 210 having a discontinuous chip arrangement are matched and coupled with each other as essential components.

Figure 12:
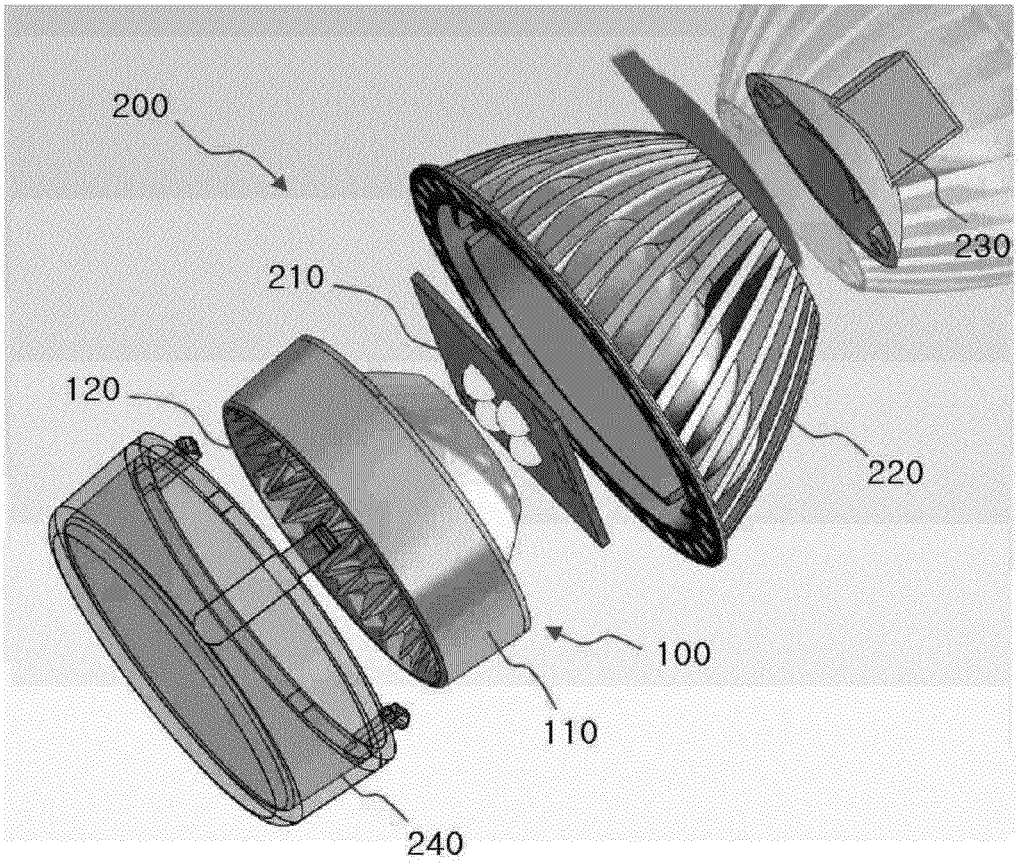
FIG. 12 is a view illustrating an LED lamp for use in MR lamp replacement which includes a reflector according to the present disclosure.

As an example, when it is desired to configure an LED lamp for replacing an MR16 lamp which is an existing halogen lamp, as exemplified in FIG. 12, the LED lamp may be configured to include an LED package 210 having a discontinuous chip arrangement structure, a reflector 100 having a trigonometric cross-wave pattern part 120 configured on inner wall thereof to remove a yellow pattern generated on a light irradiation surface for divergent light of the LED package 210, a heat sink 220 configured to exhibit a heat dissipation action when the LED package 210 is operated, and a cover 240 configured to protect the LED package 210 and disposed above the reflector 100.

At this time, the LED lamp may further include a socket 230 configured to connect a power supply to the LED package 210 so as to supply power to the LED package 210. The cover 240 may be formed of a translucent or transparent material.

Here, the reflector 100, the heat sink 220, and the cover 240 may be formed to have a size which corresponds to that of the existing MR16 lamp.

Such an LED lamp 200 may be used for indoor lighting or display lighting of a department store, a shop, a hotel, or a restaurant in place of an existing MR16 lamp. As described above, since a radiation angle in the range of 55 to 60 degrees may be formed and a yellow pattern or a hot spot, which is not removed by forming any pattern when an LED lamp is used in place of an existing MR lamp, may be easily removed, an inexpensive product can be implemented while improving efficiency as compared to an existing one.

Figure 13:
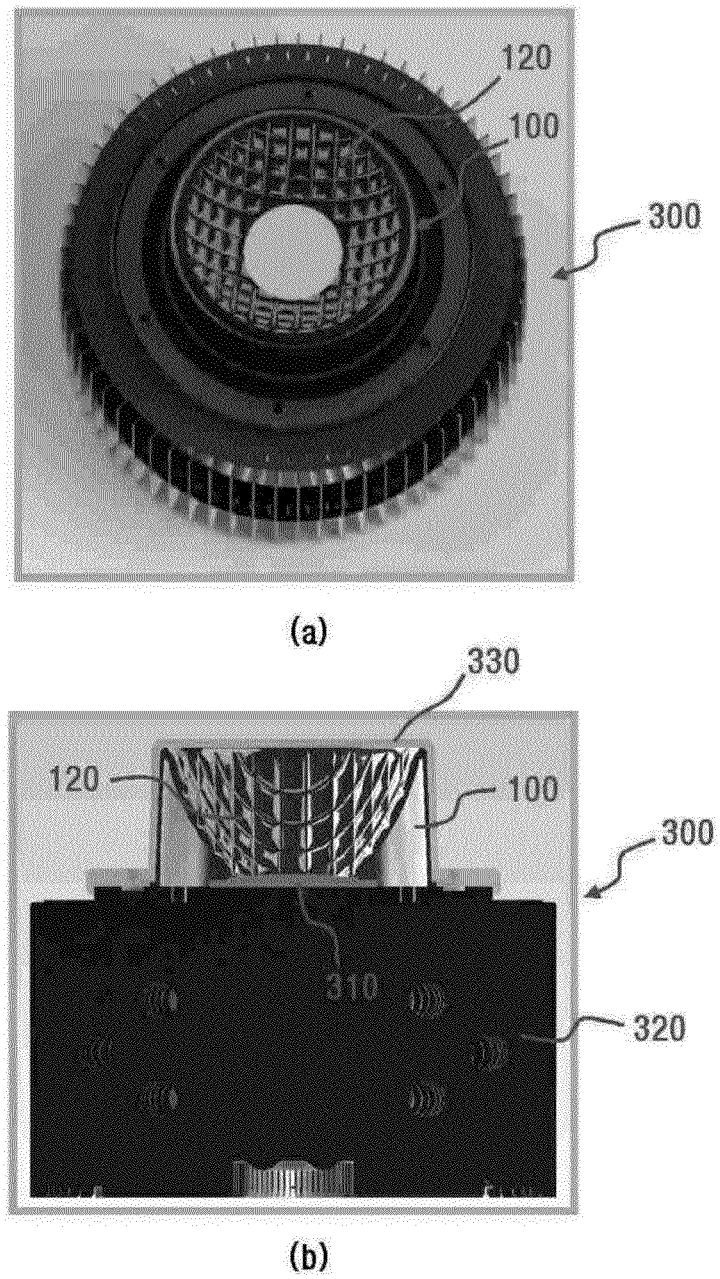
FIG. 13 is a view illustrating another embodiment of an LED lamp including a reflector having a reflection pattern for compensating for a lighting characteristic of an LED package according to the present disclosure.

FIG. 13 is a view illustrating another embodiment of an LED lamp 300 including a reflector 100 having a reflection pattern for compensating for a lighting characteristic of an LED package according to the present disclosure FIG. 13, in which the LED lamp 300 may be used as a flood light, a spotlight or the like.

The LED lamp 300 may include an LED package 310 having a discontinuous chip arrangement structure, a reflector 100 having a trigonometric cross-wave pattern part 120 formed on an inner wall thereof to remove a yellow pattern generated on a light irradiation surface for divergent light of the LED package, a heat sink 320, and a cover 330.

Figure 14:
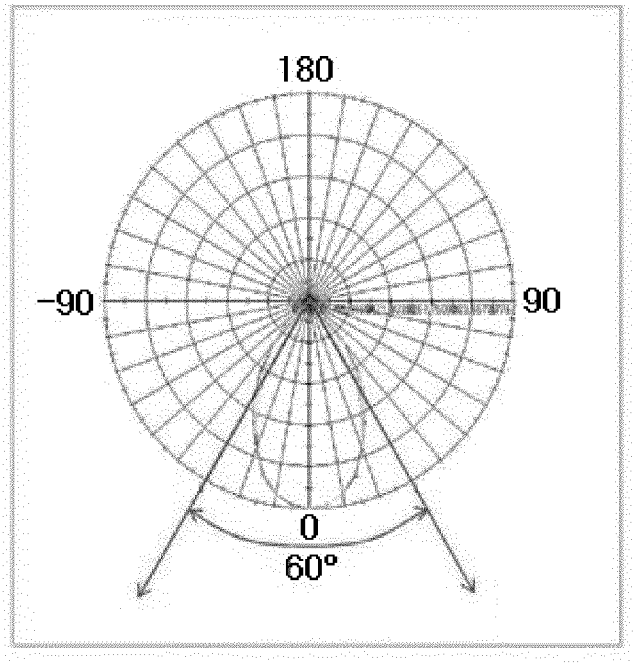
FIG. 14 is a simulation view illustrating a radiation pattern of the lamp according to the embodiment of FIG. 13.
Figure 15:
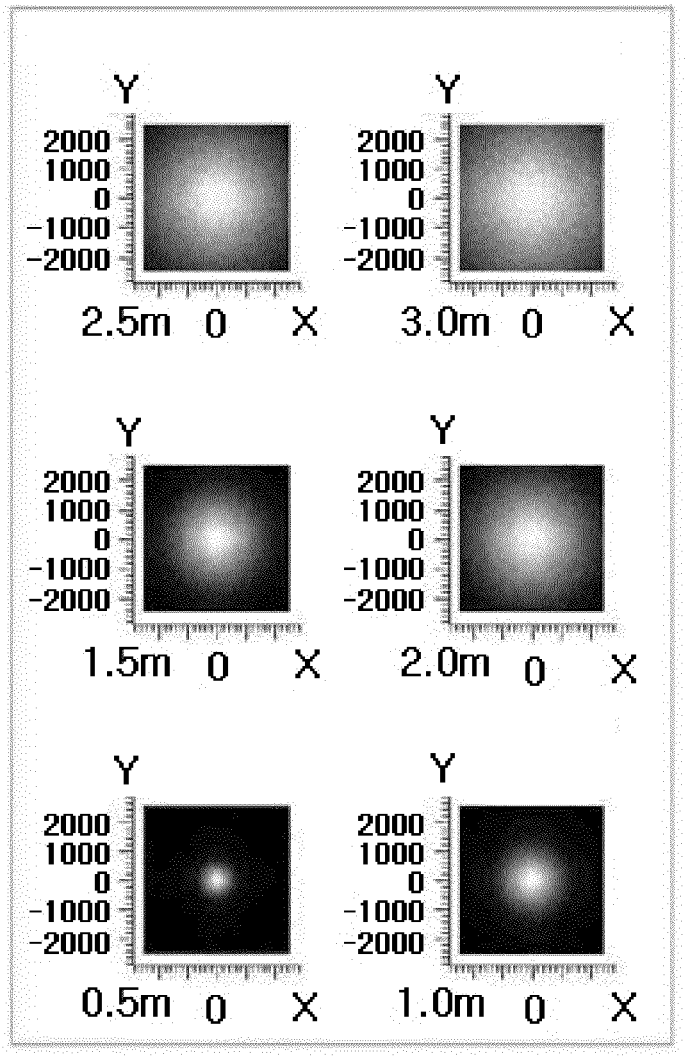
FIG. 15 is a simulation view illustrating RGB charts for respective distances of the LED lamp according to the embodiment of FIG. 13.

Such a configuration allows divergent light of the LED package to form a radiation angle of 60 degrees like a radiation pattern illustrated in FIG. 14. As can be seen from the RGB charts for respective distances as illustrated in FIG. 15, the central part is bright.

Figure 16:
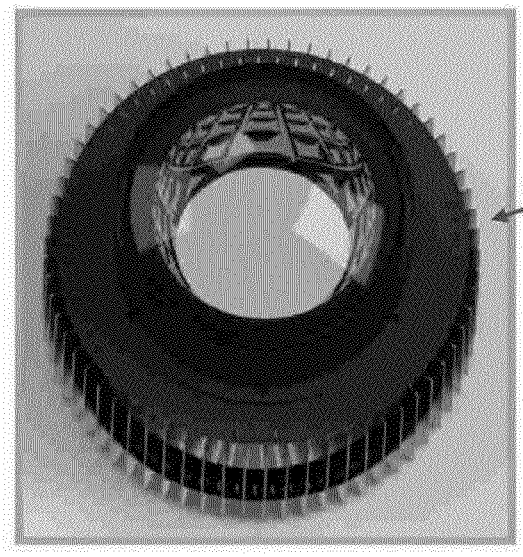
FIG. 16 is a view illustrating still another embodiment of an LED lamp including a reflector having a reflection pattern for compensating for a lighting characteristic of an LED package according to the present disclosure.
Figure 16:
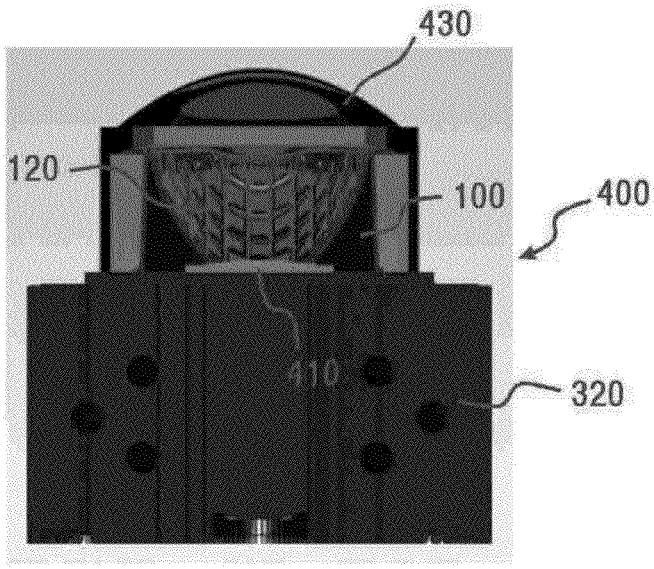

Meanwhile, FIG. 16 is a view illustrating still another embodiment of an LED lamp 400 including a reflector 100 having a reflection pattern for compensating for a lighting characteristic of an LED package according to the present disclosure. At this time, the LED lamp 400 is configured to be used for a spotlight of a stadium or a search light lamp through an array arrangement.

The LED lamp 400 also includes an LED package 410 having a discontinuous chip arrangement structure, a reflector 100 having a trigonometric cross-wave pattern part 120 formed on the inner wall thereof to remove a yellow pattern generated on a light irradiation surface for divergent light of the LED package, a heat sink 420, and a transparent cover 430 formed as an aspheric lens.

At this time, the transparent cover 430 formed as the aspheric lens is disposed above the reflector 100 to serve as a protection cover of the reflector 100 and to provide a waterproof function and a function of narrowing the radiation angle of light passing through the reflector 100.

Here, the transparent cover 430 is a lens structure which is formed of any one selected from glass, silicon, polycarbonate (PC), polymethylmethacrylate (PMMA), and cycloolenfin copolymer (COC) and the outer surface of the transparent cover 430 is formed preferably in a convex structure so as to narrow the radiation angle of light.

The transparent cover 430 is provided to adjust divergent light of the LED package 410 to form a final radiation angle in a range of 35 to 40 degrees through the additional configuration of the aspheric lens after the divergent light of the LED package 410 has been controlled by the reflector 100 to form a radiation angle to be in the range of 55 to 60 degrees.

Figure 17:
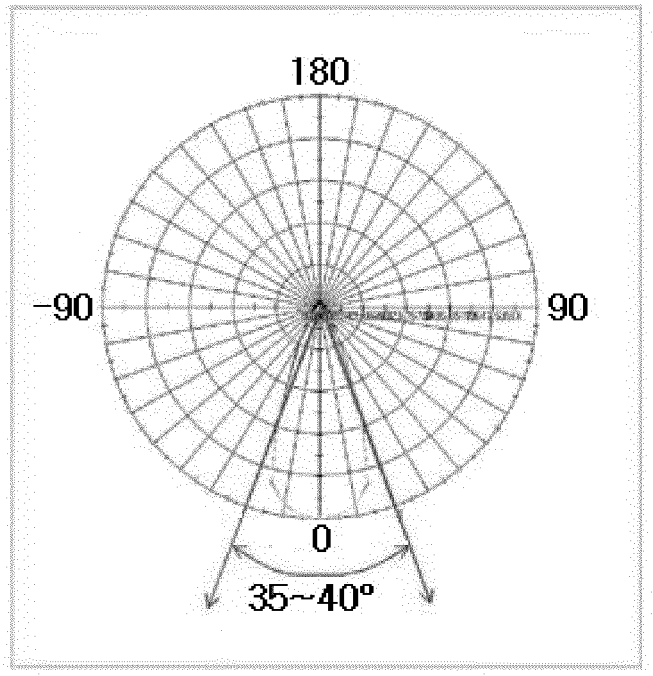
FIG. 17 is a simulation view illustrating a radiation pattern of the lamp according to the embodiment of FIG. 16.
Figure 18:
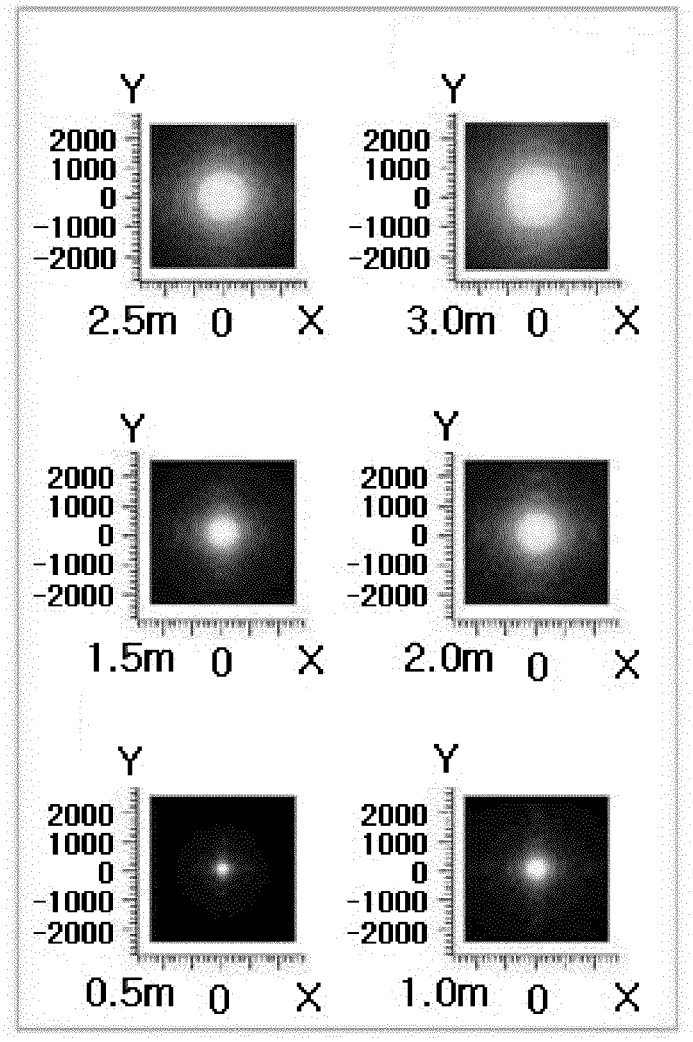
FIG. 18 is a simulation view illustrating RGB charts for respective distances of the LED lamp according to the embodiment of FIG. 16.

Such a configuration forms the radiation angle in the range of 35 to 40 degrees for the divergent light of the LED package as in the radiation pattern illustrated in FIG. 17 and forms a bright portion at the center in an inner central round portion and provides a brightness which is similar to that of the center at a portion around the center as well, as illustrated in each of RGB charts for respective distances as illustrated in FIG. 18.

Figure 19:
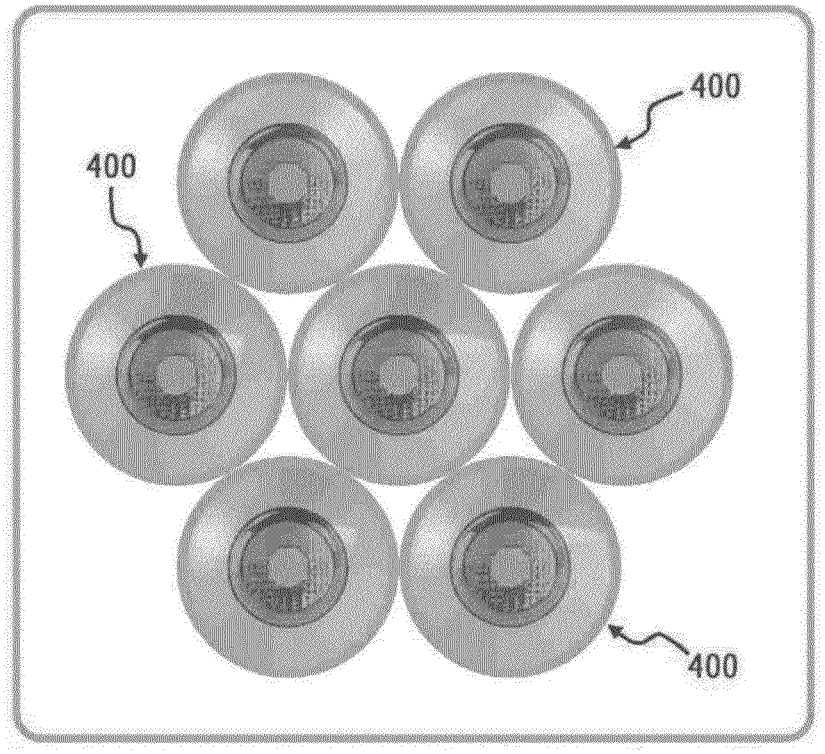
FIG. 19 is an illustrative view illustrating a configuration of an array arrangement of LED lamps according to the embodiment of FIG. 16.
Figure 20:
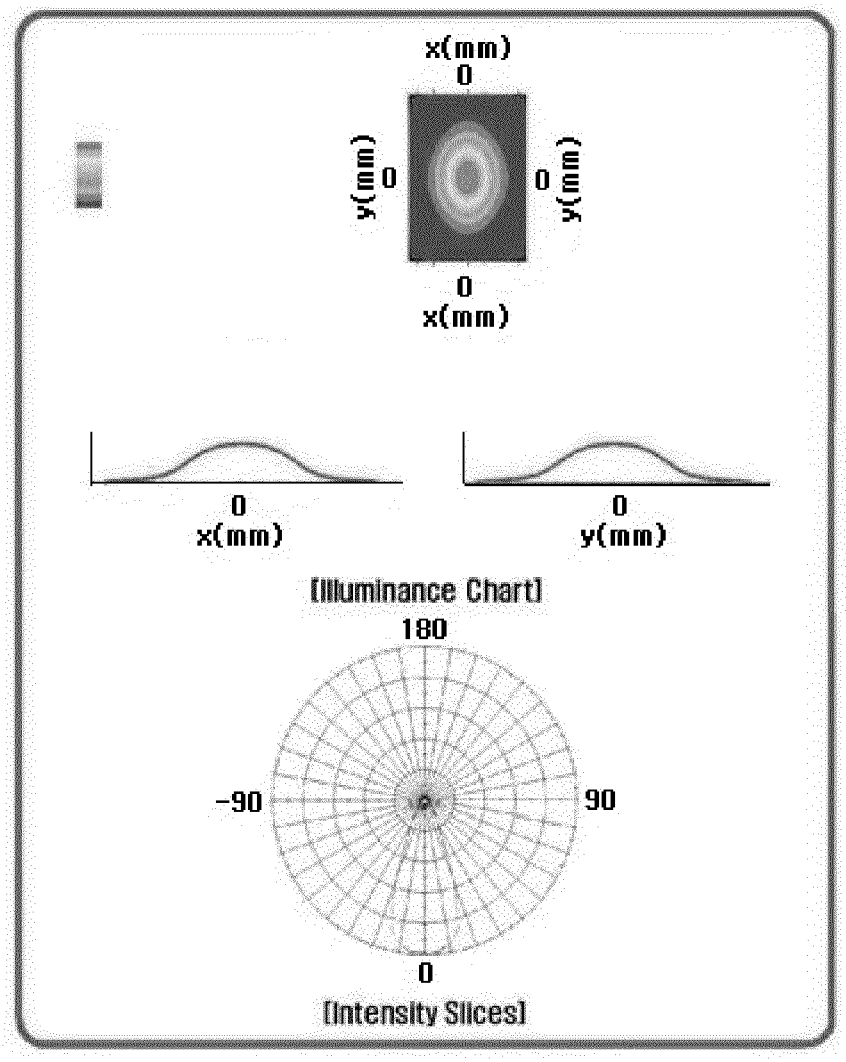
FIG. 20 is a view illustrating simulation data of the LED lamps of the array arrangement of FIG. 19.

In addition, a plurality of LED lamps 400 according to the above-described still another embodiment may be arranged as an array to form one set as illustrated in FIG. 19 to function as a 700 W search light. As shown in the simulation view of FIG. 20 illustrating a light distribution density and a radiation pattern, the LED lamps 400 can usefully function as a search light.

The LED lamp 400 may also be used as a head lamp for a vehicle or a motorcycle, a stadium spotlight, a light of a harbor or the like through a configuration including the reflector 100 and the transparent cover 430 formed by an aspheric lens.

Accordingly, the present disclosure may increase an application range of an LED lamp and may provide an LED lamp which is suitable for use purpose and excellent in efficiency and may be implemented at a low cost.

The embodiments described above are provided merely for describing preferred embodiments of the present disclosure. However, the present disclosure is not limited to the embodiments, and various modifications and substitutions may be made by a person ordinarily skilled in the art.

INDUSTRIAL APPLICABILITY

The present disclosure relates to an industrially applicable reflector having a reflection pattern for compensating for a lighting characteristic of an LED package and an LED lamp including the reflector. The reflection pattern is capable of compensating for an unstable chip configuration of an LED package itself due to discontinuous chip mounting and an incomplete lighting characteristic caused by the unstable configuration, improving LED lamp efficiency while using an existing LED package as a light source as it is, and enabling implementation of a product at a low cost, and an LED lamp including the reflector.

What is claimed is:

1. A reflector having a reflection pattern for compensating for a lighting characteristic of an LED package, the reflector comprising:

a body configured to be matched and coupled with the LED package having a discontinuous chip arrangement structure to improve the lighting characteristic of the LED package for divergent light, wherein the body includes an inner wall having a diameter which is increased upwardly to form a narrow bottom and a wide top and including an opening formed at a lower end thereof so as to arrange the LED package therein, wherein the inner wall of the body is formed with a trigonometric cross-wave pattern part which is patterned such that sine wave-type waves curved to form peaks and valleys are arranged to cross in a horizontal direction and a vertical direction at predetermined intervals over the whole area, wherein the body having the trigonometric cross-wave pattern part on the inner wall thereof includes a base layer formed of a polymer synthetic resin material having a polarity, an aluminum layer coated on the base layer, and a dielectric layer coated on the aluminum layer, and wherein the dielectric layer is formed of a dielectric material having a low refractive index in a range of 1.4 to 1.5.

2. The reflector of claim 1, wherein assuming that a pattern cycle of the trigonometric cross-wave pattern part is "H1" and a chip mounting cycle of the LED package is "L1", the trigonometric cross-wave pattern part is formed to satisfy Condition Equation 1 and Condition Equation 2 as follows:

$$mH_1=nL_1 (m \text{ and } n \text{ are integers}) \quad \text{Condition Equation 1}$$

$$H_1=H_i(i=2,3,4,\ldots),L_1=L_j(j=2,3,4,\ldots). \quad \text{Condition Equation 2}$$

3. An LED lamp comprising a reflector as claimed any one in claim 1.

4. The LED lamp of claim 3 further comprising:

a transparent cover disposed above the reflector to provide a protection cover function and a waterproof function, wherein the transparent cover is formed as an aspheric lens to narrow a radiation angle of light passing through the reflector.

5. The LED lamp of claim 4, wherein the transparent cover is a lens structure which is formed of any one selected from glass, silicon, polycarbonate (PC), polymethylmethacrylate (PMMA), and cycloolenfin copolymer (COC) and the outer surface of the transparent cover is formed in a convex structure.

6. The LED lamp of claim 3, wherein the LED package is a product having a plurality of chips discontinuously arranged on one single substrate in a form of 2×2, 3×3, . . . , or n×n.

* * * * *